US011005202B2

(12) United States Patent
Nogawa et al.

(10) Patent No.: US 11,005,202 B2
(45) Date of Patent: May 11, 2021

(54) CONNECTOR

(71) Applicant: Molex, LLC, Lisle, IL (US)

(72) Inventors: Yoshiteru Nogawa, Yamato (JP); Naoya Inoue, Yamato (JP); Mikiji Tanaka, Yamato (JP)

(73) Assignee: Molex, LLC, Lisle, IL (US)

( * ) Notice: Subject to any disclaimer, the term of this patent is extended or adjusted under 35 U.S.C. 154(b) by 12 days.

(21) Appl. No.: 16/658,159

(22) Filed: Oct. 21, 2019

(65) Prior Publication Data

US 2020/0153137 A1 May 14, 2020

(30) Foreign Application Priority Data

Nov. 14, 2018 (JP) ..... JP2018-213471

(51) Int. Cl.

| | |
|---|---|
| ***H01R 12/00*** | (2006.01) |
| ***H01R 12/91*** | (2011.01) |
| ***H01R 12/57*** | (2011.01) |
| ***H01R 12/71*** | (2011.01) |
| ***H01R 12/58*** | (2011.01) |
| *H01R 107/00* | (2006.01) |

(52) U.S. Cl.

CPC ..... *H01R 12/91* (2013.01); *H01R 12/57* (2013.01); *H01R 12/58* (2013.01); *H01R 12/716* (2013.01); *H01R 2107/00* (2013.01)

(58) Field of Classification Search

CPC ..... H01R 12/57; H01R 12/58; H01R 12/91; H01R 12/716; H01R 2107/00

USPC ..... 439/79–83

See application file for complete search history.

(56) References Cited

U.S. PATENT DOCUMENTS

| | | | | |
|---|---|---|---|---|
| 8,272,882 | B2 * | 9/2012 | Sakai | G01R 1/0483 439/81 |
| 8,354,854 | B2 * | 1/2013 | Sherry | G01R 1/0466 324/755.01 |
| 8,435,052 | B2 * | 5/2013 | Potters | H01R 12/57 439/80 |
| 2014/0256176 | A1 | 9/2014 | Esquivel et al. | |

FOREIGN PATENT DOCUMENTS

| | | | |
|---|---|---|---|
| CN | 201044293 | Y | 4/2008 |
| CN | 201813002 | U | 4/2011 |
| CN | 201927850 | U | 8/2011 |
| CN | 202121157 | U | 1/2012 |
| CN | 103811941 | A | 5/2014 |
| CN | 207149783 | U | 3/2018 |
| CN | 207967371 | U | 10/2018 |
| CN | 207994141 | U | 10/2018 |
| JP | H01-103278 | U | 7/1989 |
| JP | 2000315533 | A | 11/2000 |
| JP | 2003178844 | A | 6/2003 |
| JP | 2016-076646 | A | 5/2016 |
| JP | 2017-041347 | A | 2/2017 |
| JP | 2017-157617 | A | 9/2017 |
| KR | 100291289 | B1 | 6/2001 |
| TW | 201618389 | A | 5/2016 |
| TW | M566934 | U | 9/2018 |

* cited by examiner

*Primary Examiner* — Khiem M Nguyen

(57) ABSTRACT

A connector includes a housing, a terminal attached to the housing, and a bending member that connects the housing and a substrate. The bending member can electrically connect to wiring of the substrate. The housing can be inserted in an opening of a panel positioned above the substrate. A guide cap can be attached to a tip end part of the housing.

6 Claims, 12 Drawing Sheets

Prior art

CONNECTOR

RELATED APPLICATIONS

This application claims priority to Japanese Application No, 2018-213471, filed on Nov. 14, 2018, which application is incorporated herein by reference in its entirety.

TECHNICAL FIELD

The present disclosure relates to a connector.

BACKGROUND ART

Conventionally, a connector provided with a so-called floating structure is used in an electronic apparatus or electrical apparatus, in order to electrically connect a substrate such as a printed circuit board or the like covered by a panel of a housing or protective cover to wiring or the like outside of the panel. A terminal in the connector can flexibly move within a certain range, and therefore, the connector can adapt when a slight positional deviation occurs between a position of the connector secured to a substrate and a position of a connector insertion opening formed on a panel for example, refer to Patent Document 1.

FIG. 12 is a cross-sectional view illustrating a conventional connector.

In the drawing, 861 represents a cylindrical outer shield of a connector mounted to a circuit board 891, and a base end thereof is a flange part 862. Furthermore, 851 represents a center contact maintained inside the outer shield 861 through an insulating body 821, and a tail part 852 of a base end thereof is stored in a space formed at a center of the flange part 862.

The tail part 852 has a cylindrical cavity. A center terminal 871 with a lower end secured to the circuit board 891 is stored in the cavity. A tapered coil-shaped center coil spring 875 is also stored in the cavity. The center coil spring 875 has a lower end that engages with an inner flange 852*a* formed on a lower end of the cavity, and an upper end that engages with a head part of the center terminal 871. A ceiling surface of the cavity presses against an upper surface of the head part of the center terminal 871 based on a spring force thereof. As a result, an electrical connection is maintained between the center contact 851 and center terminal 871, Furthermore, the flange part 862 also has a cylindrical cavity. An outer terminal 871 with a lower end secured to the circuit board 891 is stored in the cavity. A tapered coil-shaped outer coil spring 876 is also stored in the cavity. The outer coil spring 876 has a lower end that engages with a spring receiving ring 872*b* secured to the outer terminal 872, and an upper end that engages with a ceiling surface of the cavity. An upper surface of the flange part 862 on an outer of the cavity presses against a lower surface of an upper end flange part 872*a* of the outer terminal 872 based on a spring force thereof. As a result, an electrical connection is maintained between the outer shield 861 and outer terminal 872.

Furthermore, when the connector mounted to the printed circuit board 891 is inserted in a connector insertion opening 895*a* formed on a panel 895, the cylindrical cavity of the tail part 852 can positionally deviate in a lateral direction with regard to the center terminal 871, and the cylindrical cavity of the flange part 862 can positionally deviate in a lateral direction with regard to the outer terminal 872, even if a center position of the connector insertion opening 895*a* deviates in a lateral direction with regard to a center position of the cylindrical outer shield 861 as illustrated in the drawing. Therefore, the connector can adapt.

Patent Document 1: Japanese Unexamined Patent Application Publication No. 2017-041347

SUMMARY

However, even if a floating structure is provided in the conventional connector, when the connector is inserted into the connector insertion opening 895*a* formed on the panel 895 and a position of the connector deviates from a position of the connector insertion opening 895*a*, an upper end of the connector may contact a lower surface of the panel 895*a*, thereby damaging the upper end of the connector. Furthermore, when the number of connectors is high and positions of the connectors deviate from positions of the connector insertion openings 895*a* corresponding thereto, time is required until the positions of all connectors are corrected and the connectors are inserted into the corresponding connector insertion openings 895*a*.

Herein, in view of the foregoing, an object of the present invention is to provide a connector that has a simple structure, can be smoothly inserted into an opening of a panel, has a simple inserting operation into an opening of a panel, and has high reliability.

Therefore, a connector contains: a housing; a terminal attached to the housing; and a bending member that connects the housing and a substrate; where the bending member can electrically connect to wiring of the substrate, the housing can be inserted in an opening of a panel positioned above the substrate, and a guide cap can be attached to a tip end part of the housing.

Another connector contains: a first housing; a first terminal attached to the first housing; a second housing; a second terminal attached to the first housing; and a bending member that connects the first housing and second housing; wherein the first housing can be connected to a substrate side connector mounted on a substrate, the second housing can be inserted in an opening of a panel position above the substrate, and a guide cap can be attached to a tip end part of the second housing.

Furthermore, in yet another connector, the second housing has an essentially cylindrical shape, and the guide cap has an essentially conical shape.

Furthermore, in yet another connector, the bending member is an electrically conductive rod-shaped member, and the first terminal and second terminal are connected on both ends.

Furthermore, in yet another connector, the guide cap includes a protruding part where a tip end protrudes from a bottom surface thereof, a recessed part is formed at a center of a tip end surface of a tip end part of the second housing, and the tip end of the protruding part of the guide cap is further inserted in the recessed part and attached to the tip end part of the second housing.

Furthermore, in yet another connector, the protruding part has a cylindrical shape, and a cylindrical wall thereof is cut by a slit extending parallel with a center axis of a cylinder.

Furthermore, in yet another connector, the first housing and second housing essentially have the same structure, and contain a terminal storing cavity that penetrates from a tip end surface to a base end surface, and a mating terminal can be inserted into the terminal storing cavity from the tip end surface.

According to the present disclosure, a connector can be smoothly inserted into an opening of a panel, even while having a simple structure, and can have improved reliability with a simple inserting operation into an opening of a panel.

BRIEF DESCRIPTION OF DRAWINGS

FIG. 7A is an upper surface view, FIG. 7B is a side surface view, and FIG. 7C is a cross-sectional view.

FIG. 8A is a first side surface view and FIG. 8B is a second side surface view as viewed in a direction orthogonal to FIG. 8A.

FIG. 9A is an upper surface view, FIG. 9B is a side surface view, FIG. 9C is a lower surface view, and FIG. 9D is a cross-sectional view.

FIG. 10A is a view as viewed from a tip end side and FIG. 10B is a view as viewed from a base end side.

FIG. 11A is a lower surface view and FIG. 11B is a cross-sectional view.

DETAILED DESCRIPTION OF THE PREFERRED EMBODIMENTS

An embodiment will be described in detail below with reference to the drawings.

Figure 1:
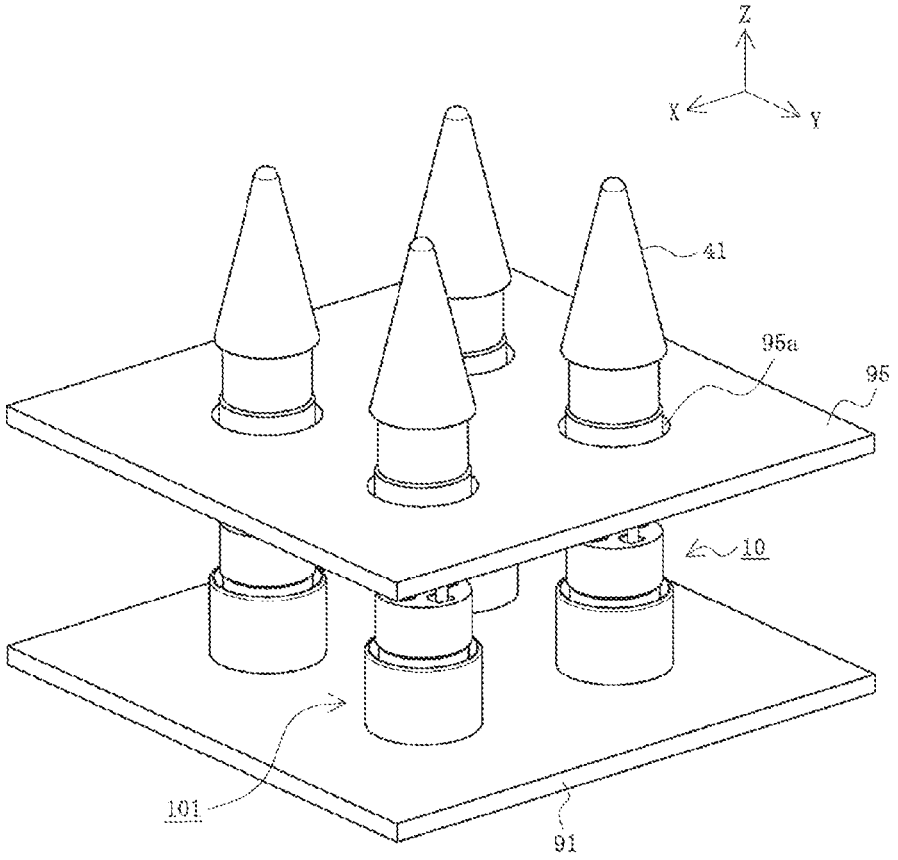
FIG. 1 is a perspective view illustrating a condition where a connector according to the present embodiment is connected to a substrate and inserted in an insertion opening of a panel.
Figure 2:
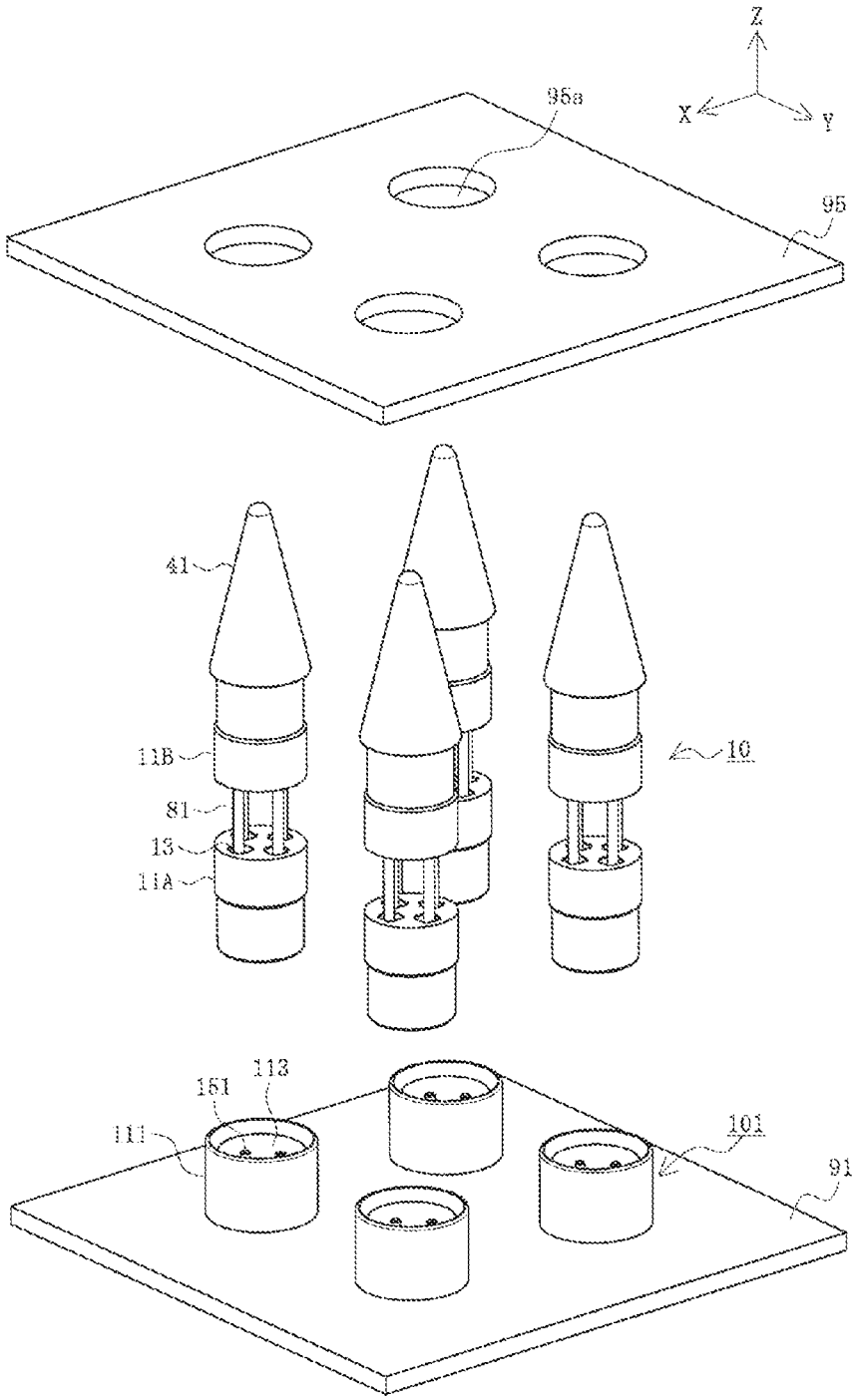
FIG. 2 is an exploded view illustrating a condition where the connector, substrate, and panel according to the present embodiment are separated.
Figure 3:
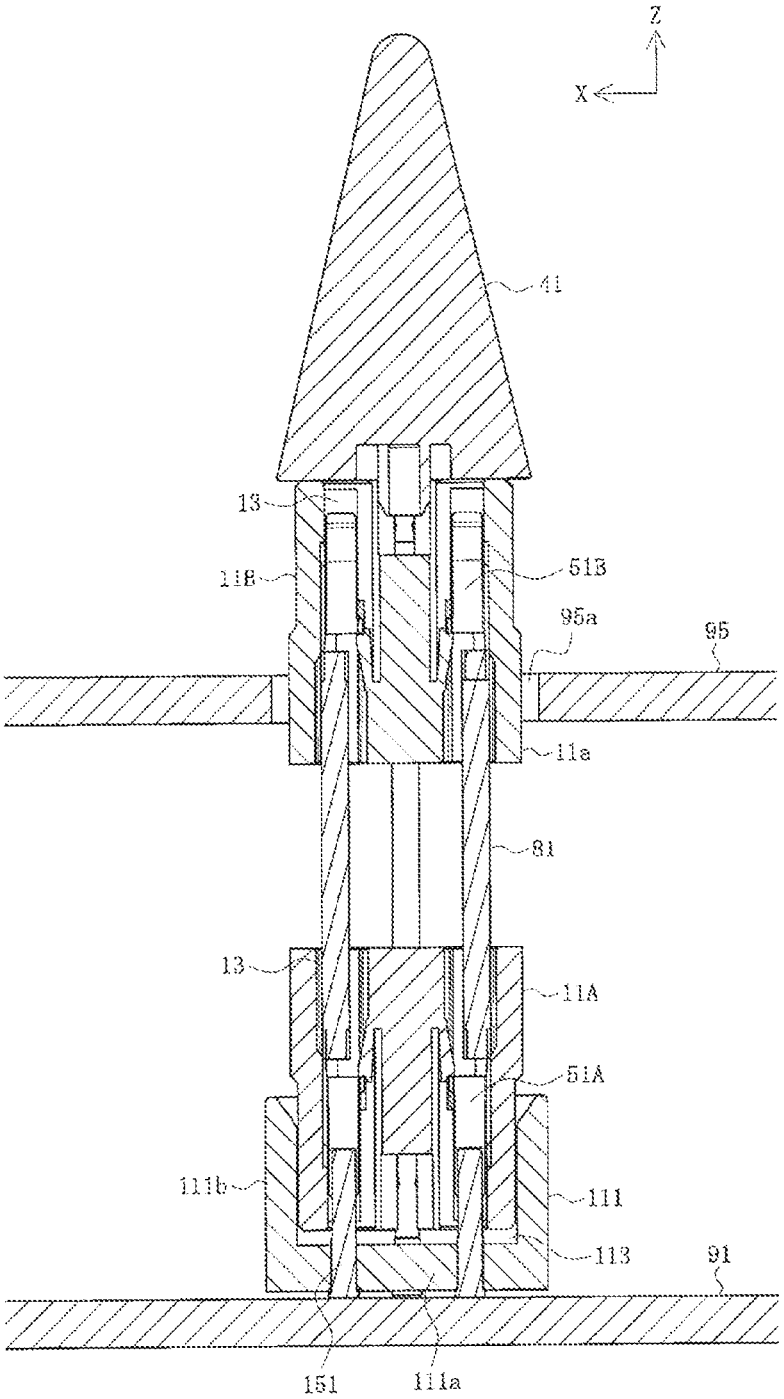
FIG. 3 is a longitudinal cross-sectional view illustrating a condition where the connector according to the present embodiment is connected to a substrate and inserted in an insertion opening of a panel.
Figure 4:
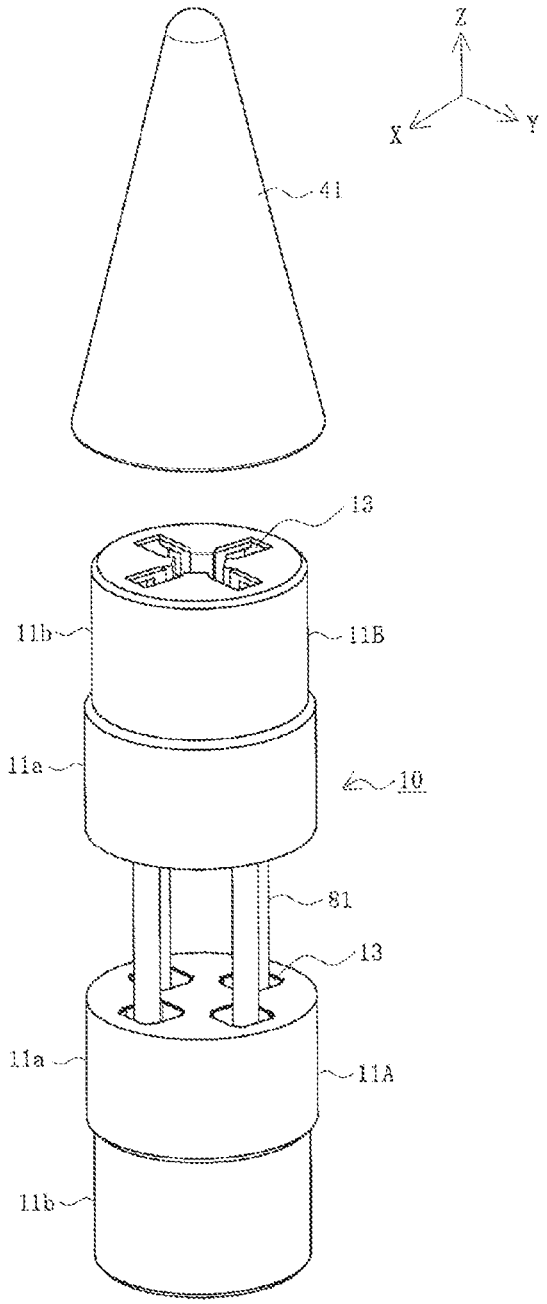
FIG. 4 is a perspective view of the connector according to the present embodiment.

FIG. 1 is a perspective view illustrating a condition where a connector according to the present embodiment is connected to a substrate and inserted in an insertion opening of a panel; FIG. 2 is an exploded view illustrating a condition where the connector, substrate, and panel according to the present embodiment are separated; FIG. 3 is a longitudinal cross-sectional view illustrating a condition where the connector according to the present embodiment is connected to a substrate and inserted in an insertion opening of a panel; and FIG. 4 is a perspective view of the connector according to the present embodiment.

In the drawings, 10 represents a connector according to the present embodiment, which functions as a relay connector that electrically connects a substrate 91 and mating member that is not illustrated in the drawings. Note that the connector 10 provides a structure having flexibility, and can be said to be a type of a so-called floating connector. Examples of the substrate 91 include printed circuit boards, flexible flat cables (FFC), flexible printed circuit boards (FPC), and the like used in electronic devices or the like, however, substrate 91 may be any type of substrate.

Note that expressions indicating directions such as up, down, left, right, front, and back used to describe an operation and configuration of parts of the connector 10 and other members in the present embodiment are relative directions and are not absolute directions, and though appropriate when the parts of the connector 10 and other members are in a position illustrated in the drawings, these directions should be interpreted differently when the position changes, corresponding to the change.

Furthermore, 101 represents a substrate side connector mounted to a surface of the substrate 91. The connector 10 is connected to the substrate 91 by mating with the corresponding substrate side connector 101. Furthermore, 95 represent a panel disposed above the substrate 91. For example, the panel may be a part of a wall of a housing of an electronic apparatus, electrical apparatus, or the like, may be a part of a protective cover that covers the substrate 91, or may be a part of another part, device, or the like loaded in the electronic apparatus, electrical apparatus, or the like. Note that a position in a height direction (Z direction) of the panel 95 with regard to the substrate 91 may be determined based on any means such as a supporting member or the like. Furthermore, the mating member is present above the panel 95, and the connector 10 is connected to the mating member by mating with a mating connector provided by the mating member, in a condition where an upper end thereof is inserted into an insertion opening 95*a*, which is an opening formed in the panel 95.

Note that in an example shown in the drawings, the number of connectors 10 is four, however, the number is not limited thereto. The number of connectors 10 may be five or more, three or less, or one. Furthermore, the number of substrate side connectors 101 mounted to the substrate 91 and number of insertion openings 95*a* penetrating the panel 95 in a plate thickness direction thereof are set to correspond to the number of connectors 10.

The substrate side connectors 101 are integrally formed by an insulating material such as synthetic resin or the like, and are provided with a substrate side housing 11 having an essentially cylindrical shape, and a substrate side terminal 151 formed from an electrically conductive material such as metal or the like loaded in the substrate side housing 111. The substrate side housing 111 has a cylindrical side wall 111*b* and a disk-shaped bottom plate 111*a* that blocks a lower end of the side wall 111*b*. The lower end is demarcated by the bottom plate 111*a*, and a mating recessed part 113 with an open upper end is formed on an inner of the side wall 111*b*. Furthermore, the substrate side terminal 151 is a rod-shaped member that extends in a vertical direction, and a plurality (four in the example illustrated in the drawings) thereof penetrate the bottom plate 111*a* in the vertical direction to attach to the bottom plate 111*a*. A lower end of each substrate side terminal 151 protruding downward from a lower surface of the bottom plate 111*a* is connected to a connecting member such as a connection pad or the like (not illustrated in the drawings), formed on a surface of the substrate 91, in a conductive manner by means such as soldering or the like. Furthermore, an upper portion including an upper end of each substrate side terminal 151 extends upward from an upper surface of the bottom plate 111*a* in the mating recessed part 113.

Each connector 10 is provided with: a lower housing 11A as a first housing integrally formed by an insulating material such as a synthetic resin or the like; upper housing 11B as a second housing integrally formed by an insulating material such as synthetic resin or the like; and flexible bending members 81 that connect the lower housing 11A and upper housing 11B. The lower housing 11A and upper housing 11B have essentially the same structure. Note that the lower housing 11A and upper housing 11B will be described as a housing 11 when described in an integrated manner.

The bending member 81 may be a single or plurality of members. However, as illustrated in the drawings, a description will be made herein assuming that there are four bending members, similar to the substrate side terminal 151. Furthermore, the bending members 81 may be any member so long as the member is long and thin, has electrical conductivity and flexibility, and has hardness sufficient to be able to independently stand. For example, the bending members may be an electrical wire. Herein, a description will be made assuming that the member is a rod-shape member extending in the vertical direction, formed by pressing an electrically conductive metal plate. Furthermore, a lower terminal 51A serving as first terminal formed from an electrically conductive metal is connected to a lower end of the bending member 81, and an upper terminal 51B serving as a second terminal formed from an electrically conductive metal is connected to an upper end thereof. The lower terminal 51A and upper terminal 51B have essentially the same structure. Note that the lower terminal 51A and upper terminal 51B will be described as a terminal 51 when described in an integrated manner.

Furthermore, the lower housing 11A is a member having a cylindrical shape, and includes a base end part 11*a* positioned on an upper side, and a tip end part 11*b* positioned on a lower side and having a smaller diameter than the base end part 11*a*. The tip end part 11*b* is a portion that is inserted into the mating recessed part 113 of the substrate side connector 101. Furthermore, a terminal storing cavity 13, which is a penetration hole penetrating in the vertical direction, is formed in the lower housing 11A. The entire lower terminal 51A and the vicinity of the lower end of the bending member 81 are stored in the terminal storing cavity 13. When each of the terminal storing cavities 13 are formed at positions corresponding to the substrate side terminals 151 serving as mating terminals for the lower terminals 51A, and the tip end part 11*b* is inserted into the mating recessed part 113, at least the upper end and vicinity thereof of the substrate side terminal 151 enters a corresponding terminal storing cavity 13, and contacts the lower end terminal 51A stored in the terminal storing cavity 13 to achieve conduction.

Furthermore, the upper housing 11B is a member having a cylindrical shape, and includes a base end part 11*a* positioned on a lower side, and a tip end part 11*b* positioned on an upper side and having a smaller diameter than the base end part 11*a*. The base end part 11*a* is a portion stored in the insertion opening 95*a* of the panel 95. The tip end part 11*b* is a portion protruding upward from an upper surface of the panel 95, and is inserted in a mating recessed part of a mating connector provided by a mating member (not illustrated in the drawings). Note that an inner diameter of the insertion opening 95*a* may be set to be larger than an outer diameter of the base end part 11*a* of the upper housing 11B as illustrated in FIG. 3 and the like, or may be set to be essentially the same as the outer diameter of the base end part 11*a* of the upper housing 11B. In other words, the base end part 11*a* of the upper housing 11B may be displaceable in a radial direction in the insertion opening 95*a*, or displacement in the radial direction may be restricted.

Furthermore, a terminal storing cavity 13, which is a penetration hole penetrating in the vertical direction, is stored in the upper housing 11B. The entire upper terminal 51B and vicinity of the upper end of the bending member 81 are stored in the terminal storing cavity 13. Furthermore, when the tip end part 11*b* is inserted in the mating recessed part of the mating connector, at least a portion of the mating terminal (not illustrated in the drawings) of the mating connector enters the terminal storing cavity 13, and contacts the upper terminal 51B stored in the terminal storing cavity 13 to achieve conduction.

In the present embodiment, before the upper end of the connector 10 is inserted in the insertion opening 95*a* of the panel 95, a guide cap 41 is attached to the upper housing 11B. The guide cap 41 is an essentially conical member that is integrally formed by an insulating material such as a synthetic resin or the like, and is attached to the upper end of the tip end part 11*b* of the upper housing 11B in a condition where a tip end thereof faces upward. Note that when the guide cap 41 is unnecessary, for example, when mated with the mating connector, the guide cap 41 is removed from the tip end part 11*b* of the upper housing 11B.

Next, a configuration of the parts of the connector 10 will be described below in detail.

Figure 5:
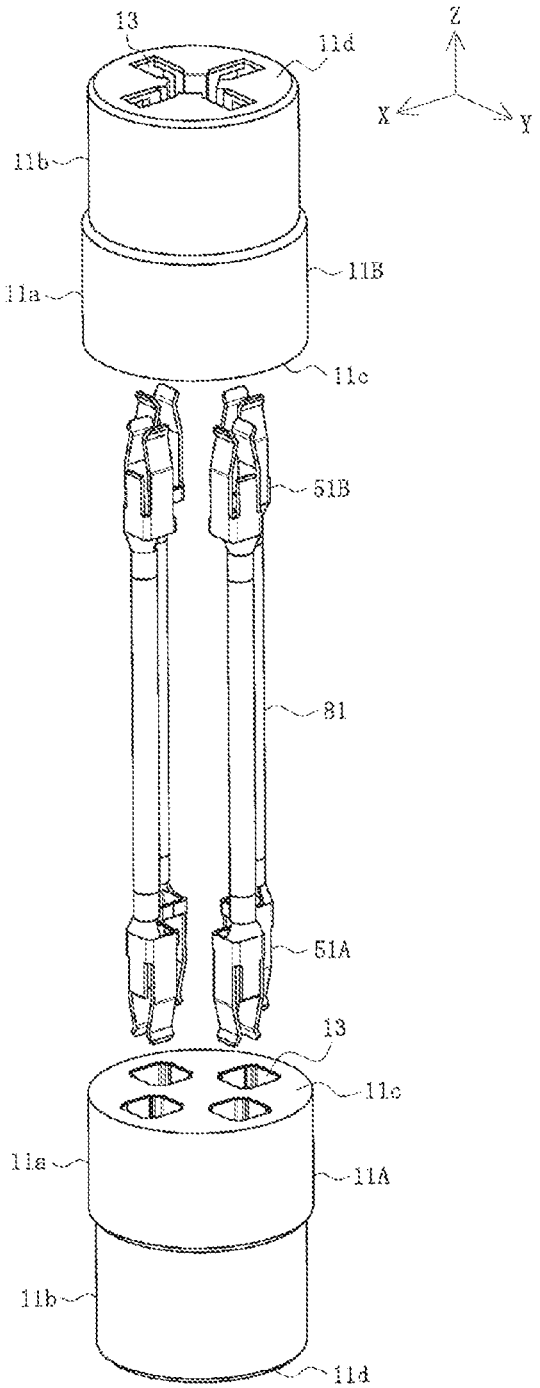
FIG. 5 is an exploded view of the connector according to the present embodiment.
Figure 6:
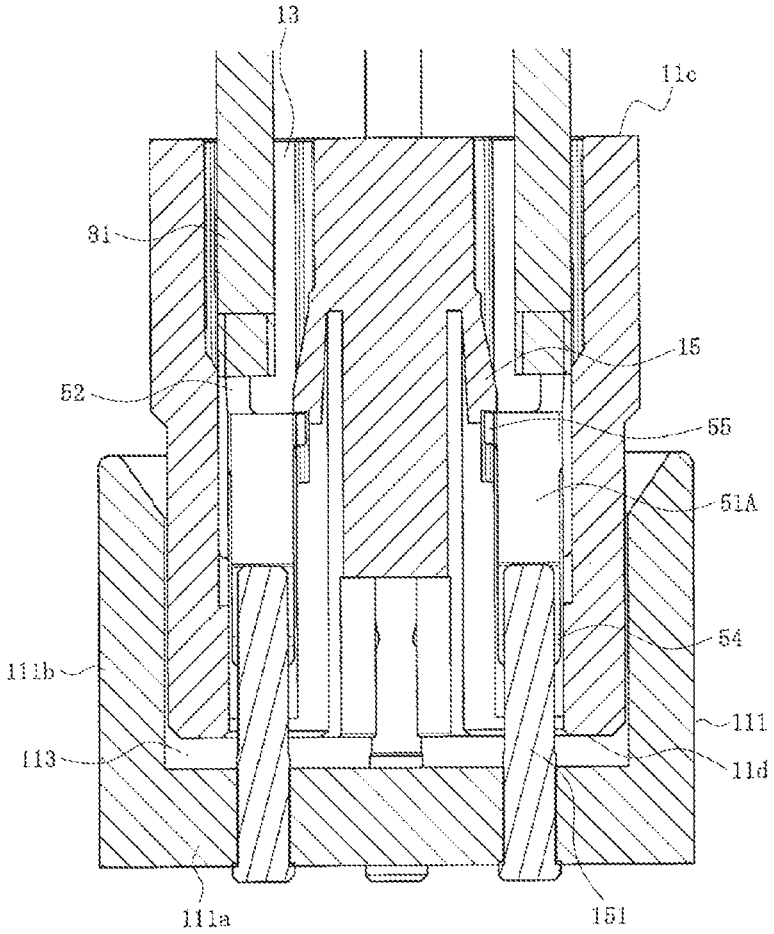
FIG. 6 is a cross-sectional view illustrating a condition of mating the connector according to the present embodiment to a substrate side connector.
Figure 7A:
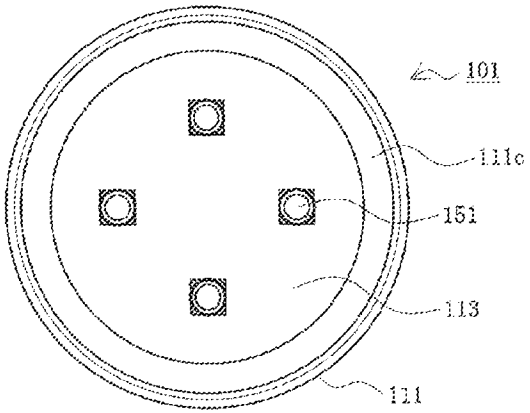
FIGS. 7A-7C are three views of the substrate side connector according to the present embodiment, where
Figure 7B:
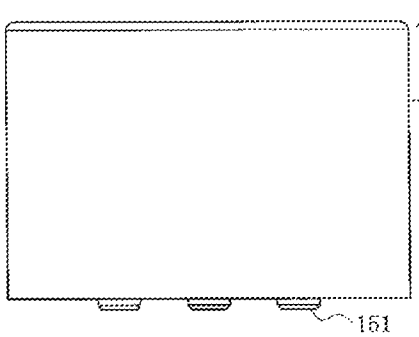
Figure 7C:
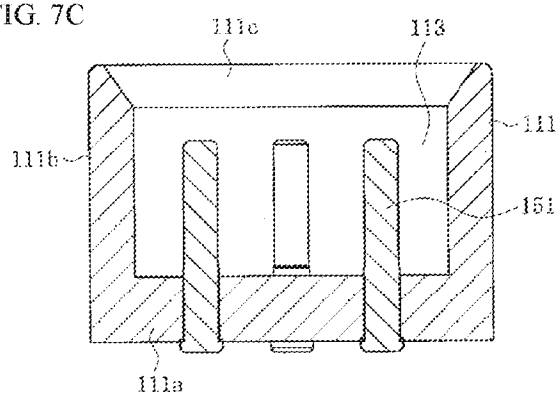
Figure 8A:
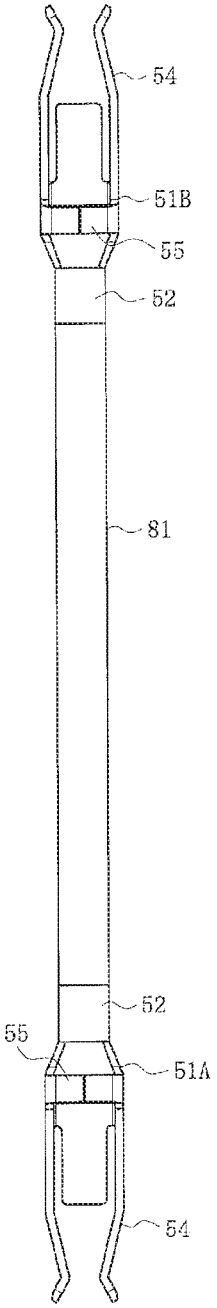
FIGS. 8A and 8B are two views of a bending member according to the present embodiment, where
Figure 8B:
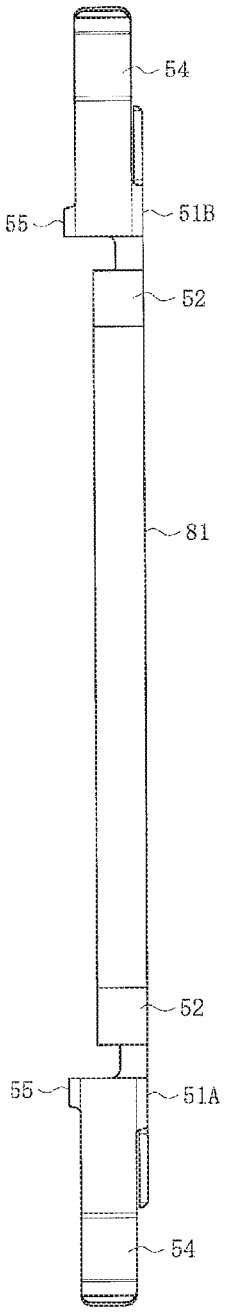
Figure 9A:
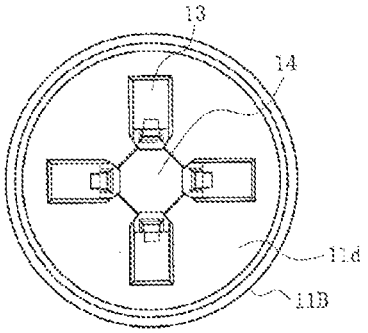
FIGS. 9A-9D are four views of an upper housing of the connector according to the present embodiment, where
Figure 9B:
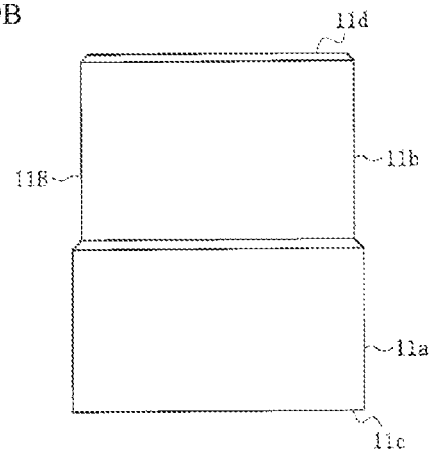
Figure 9D:
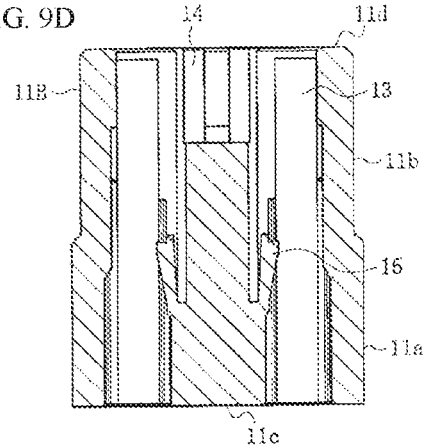
Figure 9C:
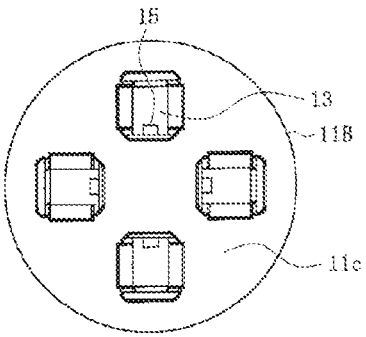
Figure 10B:
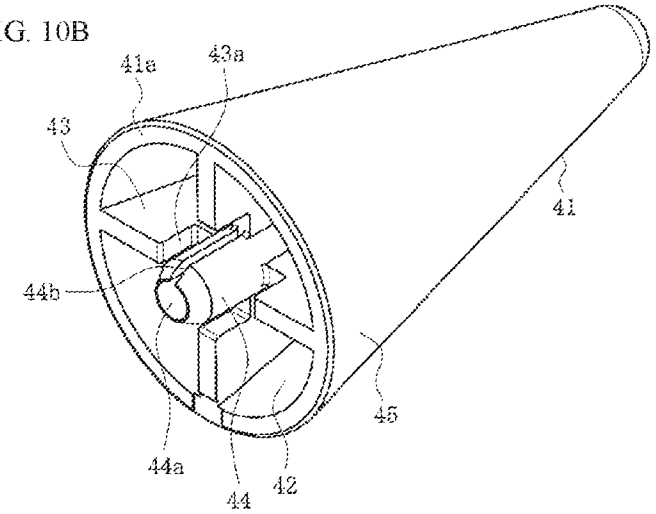
FIGS. 10A and 10B are perspective views of a guide cap according to the present embodiment, where
Figure 10A:
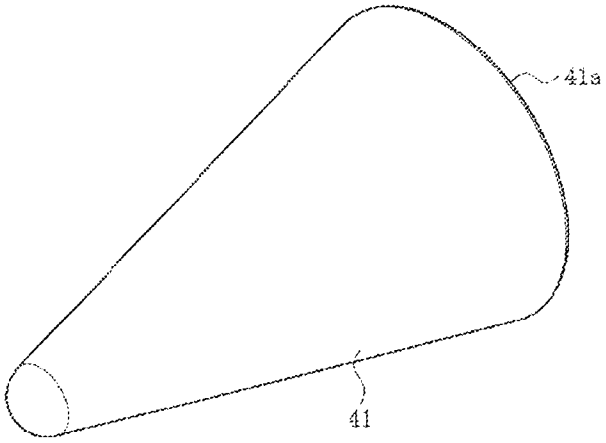
Figure 11B:
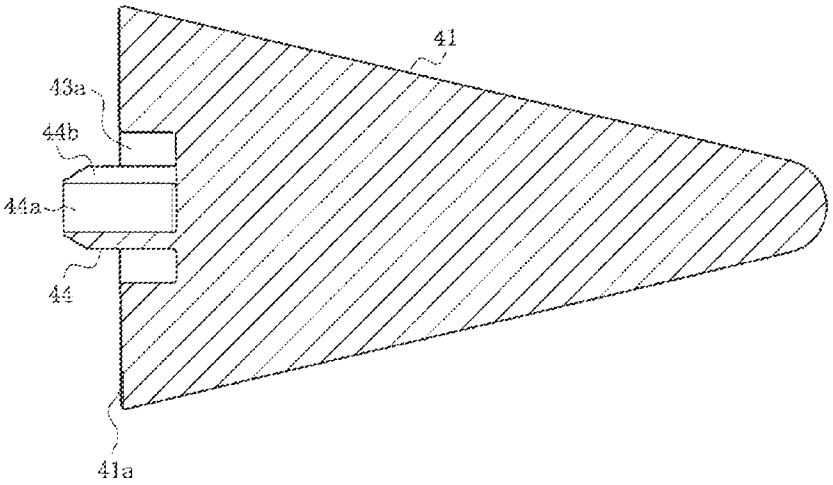
FIGS. 11A and 11B are two views of the guide cap according to the present embodiment, where
Figure 11A:
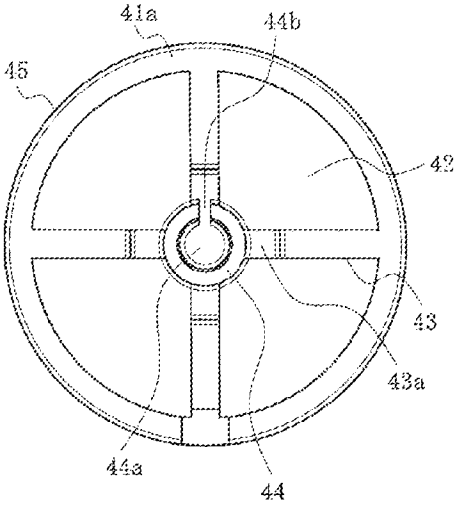
Figure 12:
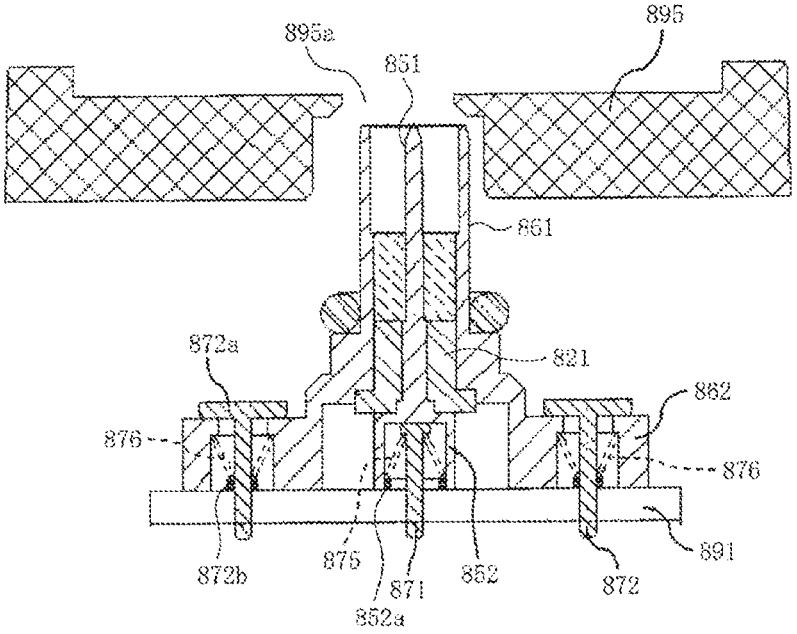
FIG. 12 is a cross-sectional view illustrating a conventional connector.

FIG. 5 is an exploded view of the connector according to the present embodiment; FIG. 6 is a cross-sectional view illustrating a condition of mating the connector according to the present embodiment to the substrate side connector; FIGS. 7A-7C are three views of the substrate side connector according to the present embodiment; FIGS. 8A and 8B are two views of the bending member according to the present embodiment; FIGS. 9A-9D are four views of the upper housing of the connector according to the present embodiment; FIGS. 10A and 10B are perspective views of the guide cap according to the present embodiment; and FIGS. 11A and 11B are two views of the guide cap according to the present embodiment. Note that in FIGS. 7A-7C, FIG. 7A is an upper surface view, FIG. 7B is a side surface view, and FIG. 7C is a cross-sectional view. In FIGS. 8A and 8B, FIG. 8A is a first side surface view, and FIG. 8B is a second side surface view as viewed from a direction orthogonal to FIG. 8A. In FIGS. 9A-9D, FIG. 9A is an upper surface view, FIG. 9B is a side surface view, FIG. 9C is a lower surface view, and FIG. 9D is a cross-sectional view. In FIGS. 10A and 10B, FIG. 10A is a view as viewed from a tip end side, and FIG. 10B is a view as viewed from a base end side. In FIGS. 11A and 11B, FIG. 11A is a lower surface view, and FIG. 11B is a cross-sectional view.

In the housings 11 as illustrated in FIG. 5, the terminal storing cavity 13 is formed so as to penetrate from a base end surface 11*c* to a tip end surface 11*d*. The terminal 51 connected to both ends of the bending member 81 is inserted in the terminal storing cavity 13 from the base end surface 11*c*. Furthermore, as illustrated in FIGS. 8A and 8B, the terminals 51 contain: a base part 52 connected to an end part of the bending member 81; a pair of contact pieces 54 extending from the base part 52 to a tip end; and a locking piece 55 protruding in a direction orthogonal to an axial direction of the bending member 81 in the vicinity of the base part 52.

Furthermore, as illustrated in FIG. 9D, a tab 15 serving as an engaging piece is formed on a side wall on a center axis side of the upper housing 11B in the terminal storing cavity 13 of the upper housing 11B. The tab 15 is a cantilever-shaped member having a base end that is integrally connected to a side wall of the terminal storing cavity 13, and a tip end (free end) that obliquely extends toward an inner side of the terminal storing cavity 13 and toward the tip end surface 11*d*. Note that the lower housing 11A has essentially the same configuration as the upper housing 11B. Therefore, the cantilever shaped tab 15 having the tip end that obliquely extends toward an inner side of the terminal storing cavity 13 and toward the tip end surface 11*d* is also formed in the terminal storing cavity 13 of the lower housing 11A.

Furthermore, as illustrated in FIG. 6, the locking piece 55 of the lower end 51A engages with the tip end of the tab 15 in a condition where the lower terminal 51A is inserted and stored in the terminal storing cavity 13 of the lower housing 11A from the base end surface 11*c*. Therefore, the lower terminal 51A stored in the terminal storing cavity 13 is prevented from being displaced toward the base end surface 11*c* side, and is not pulled out from the terminal storing cavity 13 even if the bending member 81 is pulled. Note that the upper housing 11B and upper terminal 51B have essentially the same configuration as the lower housing 11A and lower terminal 51A. Therefore, the locking piece 55 of the upper terminal 51B stored in the terminal storing cavity 13 of the upper housing 11B also similarly engages with the tip end of the tab 15. Therefore, the upper terminal 51B stored in the terminal storing cavity 13 of the upper housing 11B is prevented from being displaced toward the base end surface 11*c* side, and is not pulled out from the terminal storing cavity 13 even if the bending member 81 is pulled.

Furthermore, as illustrated in FIGS. 7A-7C, an inclined surface 111*c* serving as a chamfer is formed on an inner side of an upper end of the side wall 111*b* in the substrate side housing 111 of the substrate side connector 101. The inclined surface 111*c* exhibits a function of guiding the lower housing 11A when the lower housing 11A mates with the substrate side connector 101.

Furthermore, as illustrated in FIG. 6, the substrate side terminal 151 that has entered the terminal storing cavity 13 from the tip end surface 11*d* is in a condition interposed between the pair of contact pieces 54 of the lower terminal 51A from both sides, in a condition where the lower housing 11A is mated with the substrate side connector 101. Thereby, the substrate side terminal 151 and lower terminal 51A reliably contact each other to achieve conduction. Note that even in a condition where the upper housing 11B is mated with the mating connector, the mating terminal entering the terminal storing cavity from the tip end surface 11*d* similarly is in a condition interposed between the pair of contact pieces 54 of the upper terminal 51B from both sides. Therefore, the mating terminal and upper terminal 51B reliably contact each other to achieve conduction.

Furthermore, as illustrated in FIGS. 9A-9D, a cap maintaining recessed part 14 serving as a recessed part that is recessed toward the base end surface 11*c* is formed at a center of the tip end surface 11*d* of the upper housing 11B. In the illustrated examples, the cap maintaining recessed part 14 is connected to the nearby terminal storing cavity 13, however, the cap is not necessarily connected to the terminal storing cavity 13.

Furthermore, as illustrated in FIGS. 10A, 10B, 11A and 11B, a hollow part 42 that opens on a bottom surface 41*a* is formed on an inner side of the conical guide cap 41. However, in order to maintain an appropriate strength, a plurality of demarcating walls 42 that extend toward a center axis of a cone from a conical wall part 45 are provided. Although the number of the demarcating walls 43 can be arbitrarily set, a description is provided herein assuming there are four as illustrated in the drawings. The demarcating walls 43 extend toward the center axis of the cone from an inner surface of the wall part 45, and are mutually connected around the center axis. Thereby, the guide cap 41 is lightweight, and the wall part 45 can maintain an appropriate strength as a whole while maintaining flexibility.

Furthermore, a notch 43*a* is formed on an end part of the bottom surface 41*a* of the demarcating wall 43, and a cap maintaining protruding part 44 serving as a protruding part where a tip end thereof protrudes from the bottom surface 41*a* is provided in the notch 43*a*. The cap maintaining protruding part 44 is a cylindrical member having a center axis that is coaxial with the center axis of the cone, and has a center space 44*a* that extends in a direction of the center axis and opens at the bottom surface 41*a*. Furthermore, a slit 44*b* that extends parallel with the center axis is formed on a cylindrical wall of the cap maintaining protruding part 44, and the cylindrical wall of the cap maintaining protruding part 44 is cut by the slit 44*b*. The cylindrical wall is cut by the slit 44*b* such that the cap maintaining protruding part 44 can maintain an appropriate strength as a whole while maintaining flexibility. Note that a diameter of an outer surface of the cylindrical wall of the cap maintaining protruding part 44 is preferably set to be approximately slightly larger than an inner diameter of the cap maintaining recessed part 14.

Furthermore, as illustrated in FIG. 3, the tip end of the cap maintaining protruding part 44 protrudes from the bottom surface 41*a* in a condition where the guide cap 41 is attached to the upper housing 11B. Therefore, the tip end is inserted in the cap maintaining recessed part 14 formed at a center of the tip end surface 11*d* of the upper housing 11B. At this time, when the diameter of the cylindrical wall of the cap maintaining protruding part 44 is set to be approximately slightly larger than the inner diameter of the cap maintaining recessed part 14, the tip end of the cap maintaining protruding part 44 is in a condition pressed into the cap maintaining recessed part 14, and therefore, the guide cap 41 is prevented from unnecessarily falling out from the tip end surface 11*d* of the upper housing 11B. Note that the cap maintaining protruding part 44 has a certain degree of flexibility due to the slit 44*b*. Therefore, an insertion operation into the cap maintaining recessed part 14 can be easily performed, and a removing operation from the cap maintaining recessed part 14 can also be easily performed.

Next, an operation of connecting the connector 10 to the substrate 91 will be described.

First, as illustrated in FIG. 4, the guide cap 41 positioned above the upper housing 11B of the connector 10 is lowered relatively, while maintaining a condition where the tip end thereof faces upward, and is attached to an upper end of the tip end part 11*b* of the upper housing 11B. At this time, the tip end of the cap maintaining protruding part 44 protruding downward from the bottom surface 41*a* of the guide cap 41 is inserted into the cap maintaining recessed part 14 formed at the center of the tip end surface 11*d* of the upper housing 11B. Thereby, as illustrated in FIG. 2, the connector 10 to which the guide cap 41 is attached can be obtained.

Subsequently, as illustrated in FIG. 2, the position of the connector 10 is controlled such that the tip end surface 11 of the lower housing 11A faces the mating recessed part 113 of the substrate side housing 111, immediately above the corresponding substrate side connector 101. Note that the substrate side connector 101 is mounted in advance on a surface of the substrate 91. Furthermore, the connector 10 is relatively lowered, and the tip end part 11*b* of the lower housing 11A is inserted in the mating recessed part 113 of the substrate side housing 111. Thereby, as illustrated in FIG.

6, a condition can be achieved where the lower housing 11A is mated with the substrate side connector 101.

Furthermore, after the lower housing 11A of each connector 10 is mated with a corresponding substrate side connector 101, the panel 95 where a plurality of the insertion openings 95*a* are formed as illustrated in FIG. 2 is controlled such that the corresponding insertion opening 95*a* is positioned above each connector 10. Furthermore, the panel 95 is lowered relatively, such that the upper housing 11B of the corresponding connector 10 is inserted in the insertion opening 95*a*. Thereby, as illustrated in FIG. 1, a condition can be achieved where the upper end of each connector 10 is connected to the insertion opening 95*a* formed on the panel 95.

Note that the conical guide cap 41 with a sharp tip end is attached to the upper end of the tip end part 11B of the upper housing 11B even if the position of the insertion opening 95*a* deviates to the position of the corresponding connector 10 with regard to an X axis or Y axis direction when the panel 95 is relatively lowered and when the upper housing 11B of the corresponding connector 10 is inserted in the insertion opening 95*a*. Therefore, the upper housing 11B can smoothly enter the corresponding insertion opening 95*a*. Note that the tip end of the cap maintaining protruding part 44 is inserted in the cap maintaining recessed part 14 of the tip end surface 11*d* of the upper housing 11B, and therefore, the guide cap 41 will not fall from the upper housing 11B even if an external force is applied due to contacting an edge or the like of the insertion opening 95*a*.

Furthermore, the bending member 81 that connects the upper housing 11B and lower housing 11A has flexibility. Therefore, positional deviation is absorbed by the bending member 81 even if the position of the insertion opening 95*a* deviates from the position of the lower housing 11A of the corresponding connector 10 with regard to the X axis or Y axis direction.

Note that the guide cap 41 is removed from the upper housing 11B when the connector 10 having a tip end inserted in the insertion opening 95*a* formed on the panel 95 and the mating connector provided by the mating member (not illustrated in the drawings), positioned above the panel 95, are mated. In this case, the cap maintaining protruding part 44 with a tip end inserted in the cap maintaining recessed part 14 of the tip end surface 11*d* of the upper housing 11B has a certain degree of flexibility. Therefore, a removing operation from the cap maintaining recessed part 14 can be easily performed, and thus the guide cap 41 can be easily removed from the upper housing 11B. Furthermore, the guide cap 41 blocks the tip end surface 11*d* of the upper housing 11B until mating with the mating connector. Therefore, dust, moisture, and other foreign material can be prevented from entering into the terminal storing cavity 13 opened on the tip end surface 11*d*, and thus the reliability of the connector 10 is improved.

Furthermore, in the present embodiment, only an example was described where the connector 10 is provided with the upper housing 11A and lower terminal 51A and the lower housing 11A is connected to the substrate side connector 101 mounted to the substrate 91. However, the lower housing 11A and lower terminal 51A may be omitted, and the lower end of the bending member 81 may directly connect to wiring of the substrate 91 by means such as soldering or the like, or the bending member 81 may be directly derived from an electronic apparatus or the like attached to the substrate 91.

Thus, in the present embodiment, the connector 10 is provided with: the upper housing 11B; the upper terminal 51B attached to the upper housing 11B; and the bending member 81 connecting the upper housing 11B and the substrate 91. The bending member 81 can be electrically connected to wiring of the substrate 91, the upper housing 11B can be inserted in the insertion opening 95*a* of the panel 95 positioned above the substrate 91, and the guide cap 41 can be attached to the tip end part 11*b* of the upper housing 11B. Alternatively, the connector 10 is provided with: the lower housing 11A; the lower terminal 51*a* attached to the lower housing 11A; the upper housing 11B; the upper terminal 51B attached to the upper housing 11B; and the bending member 81 connecting the lower housing 11A and upper housing 11B. The lower housing 11A can be connected to the substrate side connector 101 mounted to the substrate 91, the upper housing 11B can be inserted in the insertion opening 95*a* of the panel 95 positioned above the substrate 91, and the guide cap 41 can be attached to the tip end part 11*b* of the upper housing 11B.

Thereby, the upper housing 11B can be smoothly inserted in the insertion opening 95*a* of the panel 95 while the connector 10 has a simple configuration. Thus, an insertion operation of the upper housing 11B into the insertion opening 95*a* is simple, and reliability of the connector 10 is improved.

Furthermore, the upper housing 11B has an essentially cylindrical shape, and the guide cap 41 has an essentially conical shape. Furthermore, the bending member 81 is a conductive rod-shaped member, and the lower terminal 51A and upper terminal 51B are connected to both ends. Furthermore, the guide cap 41 contains a cap maintaining protruding part 44 where the tip end protrudes from the bottom surface 41*a*. The cap maintaining recessed part 14 is formed at the center of the tip end surface 11*d* of the tip end part 11*b* of the upper housing 11B. The guide cap 41 is attached to the tip end part 11*b* of the upper housing 11B by inserting the tip end of the cap maintaining protruding part 44 in the cap maintaining recessed part 14. Furthermore, the cap maintaining protruding part 44 has a cylindrical shape, and the cylindrical wall thereof is cut by the slit 44*b* extending parallel to the center axis of the cylinder. Furthermore, the lower housing 11A and upper housing 11B have essentially the same structure, and contain the terminal storing cavity 13 that penetrates from the tip end surface 11*d* to the base end surface 11*c*. The substrate side terminal 151 and mating terminal can enter into the terminal storing cavity 13 from the tip end surface 11*d*.

Note that the disclosure of the present specification describes characteristics related to a preferred and exemplary embodiment. Various other embodiments, modifications, and variations within the scope and spirit of the claims appended hereto could naturally be conceived of by persons skilled in the art by summarizing the disclosures of the present specification.

The present disclosure can be applied to connectors.

The invention claimed is:

1. A connector, comprising:

a first housing;

a first terminal attached to the first housing;

a second housing;

a second terminal attached to the first housing; and a bending member that connects the first housing and second housing, wherein the first housing can be connected to a substrate side connector mounted on a substrate, and the second housing can be inserted in an opening of a panel position above the substrate, and a guide cap can be attached to a tip end part of the second housing.

2. The connector according to claim 1, wherein the second housing has an essentially cylindrical shape, and the guide cap has an essentially conical shape.

3. The connector according to claim 1, wherein the bending member is an electrically conductive rod-shaped member, and the first terminal and second terminal are connected on both ends.

4. The connector according to claim 1, wherein the guide cap includes a protruding part where a tip end protrudes from a bottom surface thereof, a recessed part is formed at a center of a tip end surface of a tip end part of the second housing, and the tip end of the protruding part of the guide cap is inserted in the recessed part and attached to the tip end part of the second housing.

5. The connector according to claim 4, wherein the protruding part has a cylindrical shape, and a cylindrical wall thereof is cut by a slit extending parallel with a center axis of a cylinder.

6. The connector according to claim 1, wherein the first housing and second housing essentially have the same structure, and contain a terminal storing cavity that penetrates from a tip end surface to a base end surface, and a mating terminal can be inserted into the terminal storing cavity from the tip end surface.

* * * * *